US005960591A

United States Patent [19]

Schlüter

[11] Patent Number: 5,960,591

[45] Date of Patent: Oct. 5, 1999

[54] SYSTEM FOR SECURING GUTTERING TO THE ENDS OF BALCONIES OR TERRACES

[75] Inventor: Werner Schlüter, Iserlohn, Germany

[73] Assignee: Schlüter-Systems GmbH, Iserlohn, Germany

[21] Appl. No.: 09/043,201

[22] PCT Filed: Sep. 17, 1996

[86] PCT No.: PCT/DE96/01781

§ 371 Date: Mar. 13, 1998

§ 102(e) Date: Mar. 13, 1998

[87] PCT Pub. No.: WO97/11240

PCT Pub. Date: Mar. 27, 1997

[30] Foreign Application Priority Data

| | | | |
|---|---|---|---|
| Sep. 22, 1995 | [DE] | Germany | 195 35 187 |
| Sep. 22, 1995 | [DE] | Germany | 195 35 185 |
| Mar. 19, 1996 | [DE] | Germany | 296 05 100 U |
| Apr. 10, 1996 | [DE] | Germany | 296 06 490 U |

[51] Int. Cl.[6] ..... E04D 13/072

[52] U.S. Cl. ..... 52/11; 52/13; 52/14; 52/15; 248/48.1; 248/48.2

[58] Field of Search ..... 52/11, 13, 14, 52/15; 248/48.1, 48.2

[56] References Cited

U.S. PATENT DOCUMENTS

| | | | |
|---|---|---|---|
| 68,765 | 9/1867 | Marshall | 248/48.1 |
| 435,173 | 8/1890 | Forbes | 248/48.1 |
| 929,684 | 8/1909 | Mills et al. | 248/48.1 |

(List continued on next page.)

FOREIGN PATENT DOCUMENTS

| | | | |
|---|---|---|---|
| 41273/68 | 1/1971 | Australia . | |
| 703314 | 2/1965 | Canada | 248/48.2 |
| 1225225 | 8/1987 | Canada . | |
| 0481819A2 | 4/1992 | European Pat. Off. . | |
| 0510216A1 | 10/1992 | European Pat. Off. . | |
| 1902209 | 6/1964 | Germany . | |
| 1959308 | 4/1967 | Germany . | |
| 8711474 U | 3/1988 | Germany . | |
| 90 04 119 U | 7/1990 | Germany . | |
| 8913663 U | 5/1991 | Germany . | |
| 29514797U1 | 9/1995 | Germany . | |
| 3701415A1 | 1/1998 | Germany . | |
| 404357260 | 12/1992 | Japan | 248/48.1 |
| 983080 | 2/1965 | United Kingdom . | |
| 2087453 | 5/1982 | United Kingdom . | |
| 2135362 | 8/1984 | United Kingdom | 52/11 |
| 2145754 | 4/1985 | United Kingdom | 52/11 |
| 2236776 | 4/1991 | United Kingdom | 52/11 |

OTHER PUBLICATIONS

Watecfin—Das Balkonentwasserungssystem (Gutjahr), pp. 1–4.

*Primary Examiner*—Carl D. Friedman
*Assistant Examiner*—Phi Dieu Tran A
*Attorney, Agent, or Firm*—Collard & Roe, P.C.

[57] ABSTRACT

A system for securing guttering to ends of balconies or terraces essentially consists of a supporting section and a gutter. Securing means are allocated to the supporting section and securing means are allocated to the gutter. Both securing means are arranged to act together to secure the gutter to the supporting section. The securing means for the supporting section consist of a support and a locking edge. The support acts as a counter-member for a suspension arm allocated to the gutter. Said suspension arm is a part of a hook-shaped suspension section. The gutter is secured to the supporting section by a bearing component which bears on the supporting arm of the supporting section and a securing member engaging behind the locking edge.

18 Claims, 7 Drawing Sheets

U.S. PATENT DOCUMENTS

| | | | |
|---|---|---|---|
| 2,271,081 | 1/1942 | Layton | 248/48.2 |
| 2,536,704 | 1/1951 | Shea et al. | 248/48.2 |
| 2,712,915 | 7/1955 | Cohen et al. | 248/48.2 |
| 3,022,029 | 2/1962 | Blayden | 248/48.2 |
| 3,150,851 | 9/1964 | Ritchie et al. | 248/48.2 |
| 3,436,878 | 4/1969 | Singer | 248/48.2 |
| 3,612,453 | 10/1971 | Zimmer . | |
| 3,630,473 | 12/1971 | Landis | 248/48.2 |
| 3,874,131 | 4/1975 | Webster | 52/11 |
| 4,314,683 | 2/1982 | Cunning | 248/48.2 |
| 4,579,303 | 4/1986 | Midlik | 248/48.2 |
| 4,581,857 | 4/1986 | Harbom | 248/48.2 |
| 4,745,657 | 5/1988 | Faye | 248/48.2 |
| 4,776,544 | 10/1988 | Williams | 52/11 |
| 5,046,692 | 9/1991 | Nicholas | 52/11 |
| 5,067,675 | 11/1991 | Brant | 248/48.2 |
| 5,575,118 | 11/1996 | Vahldieck | 248/48.1 |
| 5,617,678 | 4/1997 | Morandin et al. | 52/11 |

SYSTEM FOR SECURING GUTTERING TO THE ENDS OF BALCONIES OR TERRACES

The invention relates to a system for securing gutters on the ends of balconies or terraces.

Such a gutter mounting system is known, for example from German utility patent DE 295 14 797 01 U1. The known system comprises a supporting section with means for securing the supporting section on the side of the balcony, with a visible leg spaced from the mounting base and aligned parallel with the end of the wall, and with securing means for mounting a gutter, as well as a gutter with means for securing the latter on the supporting section, whereby the securing means of the gutter support the gutter in cooperation with the securing means of the supporting section.

The supporting means of said known system is substantially L-shaped The longer leg of the supporting section is designed as a securing leg for installing the supporting section in the floor structure of the balcony or terrace. The shorter leg is bent off, pointing downwardly, and thus represent at the same time a visible leg. An undercut groove, which is open towards the mounting base, is arranged on the inner side of the visible leg pointing at the mounting base. Said groove serves as securing means on the side of the supporting section for receiving a securing means associated with the gutter.

A hook-like suspension segment, which is insertable in the mounting groove of the supporting section, is associated with the gutter to be secured on the supporting section. Since the suspension segment of the gutter is arranged within the upper range of a gutter leg, the gutter is suspended with its suspension segment on the top edge of the lower groove bridge. So that the gutter is supported in its vertical alignment, provision is made for a strip covering the opening of the groove of the supporting section, such groove being supported on the top groove bridge of the mounting groove of the supporting section.

Supporting the strip section on the top groove bridge prevents the gutter from swinging towards the end of the balcony or terrace. However, the strip section cannot prevent the suspended gutter from swinging away from the end of the balcony or terrace, for example when subjected to attacking winds. Such swinging away from the end would pose the risk that the suspension section is moved out of the securing groove of the supporting section, causing the gutter to drop down. So that the gutter is secured against any unintended movement breaking it loose, provision is made that the front, visible leg of the gutter is supported on a railing stanchion arranged in front of the face side of the balcony or terrace.

For suspending the gutter with its suspension section in the mounting groove of the supporting section, the gutter has to be lifted over its entire length and arranged with the downwardly pointing strip of the suspension section aligned with the small groove opening, so that said strip can then be pushed into the mounting groove. When suspending longer sections, however, such aligned arrangement is difficult to accomplish under certain circumstances because greater lengths of gutter have the tendency to sag. Therefore, for sliding the suspension section into the mounting groove of the supporting section, several persons are required with greater gutter lengths for holding the gutter in the position in which it has to be mounted.

Based on the state of the art discussed above, the invention is based on the problem of proposing a system for mounting gutters on the ends of balconies or terraces, by which it is not only possible to safely secure a gutter without requiring any support on a post or stanchion of the balcony, but by which even the suspension of longer gutters is assured without the help of additional means.

According to the invention, said problem is solved by a system for securing gutters on the ends of balconies or terraces, comprising a supporting section with means for securing the supporting section on the balcony side, with a visible leg spaced from the mounting base and aligned parallel with the wall connection, and with securing means for mounting a gutter, and a gutter with means for securing the latter on the securing section, whereby the securing means of the gutter support the gutter in cooperation with the securing means of the supporting section, whereby the supporting section has a supporting leg spaced from the visible leg and disposed close to the end of the wall, said supporting leg being connected with the visible leg by a water drain leg, whereby the securing means associated with the supporting section comprise a support on the side of the visible leg and a locking edge on the side of the supporting leg, and whereby the securing means associated with the gutter are designed for insertion in a mounting gap formed by the support and the locking edge and comprise a suspension segment cooperating with the support, as well as a fixing piece cooperating with the locking edge, said fixing piece having an elastic extension which, in the mounted condition, engaged the locking edge from behind, so that said extension can be clipped into or to the supporting section, whereas the other securing means on the gutter side abuts on the support on the side of the supporting section.

By making provision for a support arranged on the inner side of the visible leg and serving as an abutment for a securing element on the gutter side, a securing element is created on the side of the visible leg on which a suspension segment on the side of the gutter can be placed without requiring any special fitting accuracy with respect to such placement. By arranging the second securing means located on the support side on the supporting leg, two securing means are created which are spaced from each other, so that the securing means on the gutter side can be mounted one after the other on the supporting section. This permits the gutter to be secured by placing the suspension segment on the support and by fixing the fixing piece on the locking edge by subsequently swinging the gutter inwardly. Due to the fact that the fixing piece is supported at the same time on the supporting leg, the gutter automatically moves into its intended position.

In the mounted condition, the securing means on the gutter side are supported clamped between the support and the locking edge, so that safe securing of the gutter is assured and wobbling is prevented at the same time.

By using two spaced-apart legs for securing the gutter, forces engaging the securing means are absorbed in a superior way and passed off into the mounting base.

In the mounted condition, the fixing piece provided as securing means on the gutter side engages the locking edge associated with the supporting section from behind. The fixing piece is an elastic extension pointing at the mounting base. When swinging in the securing means on the gutter side, whereby the suspension arm abuts on the support on the side of the supporting section, it is possible to clip the fixing piece into or to the supporting or the connecting section. The fixing piece engaging the locking edge from behind then adjusts and secures the gutter-side securing means in their predetermined positions.

In a useful embodiment provision is made that the top edge of a hook-like, upwardly open holding element pointing at the supporting leg serves as a support. Such a hook-like holding element may be designed also in the form of a lower bent-off part of the visible leg, so that the visible leg of the supporting section is stiffened in this way as well.

The suspension segment of the securing means on the gutter side is usefully hook-shaped as well; however, designed open downwardly, pointing from the gutter at the visible leg. However, so as to assure unobstructed inward swinging, the hook-like suspension segment has a suspension arm disposed oblique-angled relative to the wall of the gutter.

A locking edge arranged on the supporting leg is formed, for example in that the supporting leg of the supporting section is spaced from the mounting base and the lower end of the supporting leg is formed by the locking edge. So that the supporting leg is capable of supporting itself on the mounting base in spite of its spacing from the latter, provision is made in one embodiment that the supporting leg has supporting bridges shaped by molding on said leg. The supporting bridges have a favorable effect also when the supporting section is being installed in the floor structure of a balcony or terrace, when they serve as fitting bridges as well, so that an even spacing of the supporting leg from the mounting case can be maintained without additional measures even when long supporting sections are installed.

According to another exemplified embodiment of the supporting section, provision is made that the securing means on the side of the securing section are not directly shaped by molding on the supporting section itself, but that provision is made for said securing means on a connecting section associated with the supporting section. In such an embodiment, the supporting section has a receiving groove with groove screws arranged therein. The groove screws engage through oblong holes provided in the connecting section. In addition to securing the connecting section on the groove screws inserted in the receiving groove, said connecting section supports itself also on the inside of the visible leg of the supporting section. A vertical adjustability of the connecting section is useful if the gutter to be mounted on the supporting section is to be provided with a certain gradient. Therefore, it is not necessary to install the supporting section itself with a gradient, so that it can be installed parallel with the floor structure if it is installed in the structure of the floor with a securing leg. Furthermore, using a vertically adjustable connecting profile facilitates the mounting of such a gutter because any vertical adjustment for obtaining a gradient in the gutter is exclusively made with the relatively lightweight connecting profile.

In the installed condition, the fixing piece provided as securing means on the gutter side usefully engages the locking edge associated with the supporting section from behind. The fixing piece is an extension made of elastic material pointing at the mounting base, such extension having a front run-up surface and a locking groove. When swinging the securing means on the gutter side inwardly, whereby the suspension arm abuts on the support on the side of the supporting section, the fixing piece can be clipped into or onto the supporting or the connecting section. The securing means on the gutter side are then adjusted and secured in their predetermined positions by the fixing piece engaging the locking edge from behind.

The securing means on the gutter side can be provided by molding it on the gutter itself. However, in another embodiment provision is made that the securing means on the gutter side are arranged on a gutter hook. The gutter hook for such an embodiment can be manufactured at favorable cost, for example by injection molding method, and the gutter itself by the extrusion process.

Additional advantages and further developments of the invention are described in the dependent claims and in the following description of exemplified embodiments. In the drawing, FIG. 1 shows a cross section through a supporting section arranged on a concrete base and a gutter securable on the supporting section.

Figure 1:
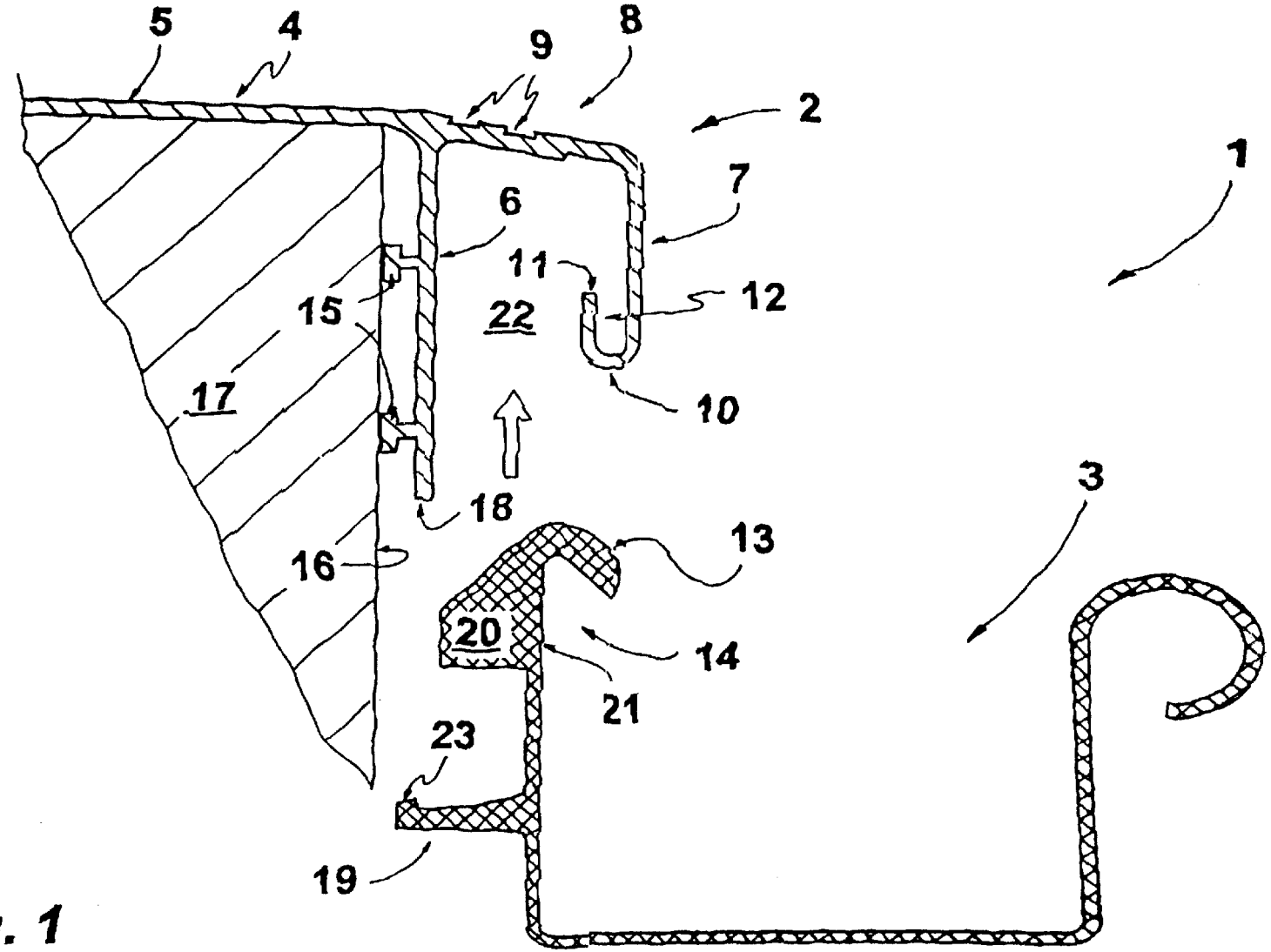

FIG. 1 shows a gutter mounting system 1 consisting of a supporting section 2 and a gutter 3. Supporting section 2 has 4 legs and a horizontally arranged securing leg 5 provided with breakthroughs 4, a supporting leg 6, a visible leg 7, and a water drain leg 8 connecting the visible leg 7 and the supporting leg 6. Dovetail-shaped clamping grooves 9 are provided in water drain 8 for the purpose of obtaining superior clamping of a seal applied to securing leg 5 and water drain leg 8.

A holding element 10 is shaped by molding on the lower end of visible leg 7. A support 11 is formed by the upwardly directed edge of said holding element, pointing into the interior of the section The U-shaped holding element 10 additionally serves as a stiffening element for reinforcing the visible leg 7. Between support 11 and the inner side visible leg 7, provision is made for a receptacle 12. A suspension arm 13 of a suspension section 14 arranged on the gutter side projects into said receptacle in the mounted condition when gutter 3 is installed.

Supporting bridges 15 are shaped by molding on supporting leg 6 and serve for supporting the supporting section on front side 16 of a balcony base 17. By spacing the supporting leg 6 from front side 16 of the balcony, the lower edge of supporting leg 6 is designed as a locking edge 18. Locking edge 18 cooperates with a fixing piece 19 arranged on the side of the gutter. Fixing piece 19 is designed in the form of an extension pointing from gutter 3 to the front side 16 of the balcony. For engaging the undercut of supporting leg 6 from behind, such undercut being formed by locking edge 18, said extension is shaped like a barb.

The securing means on the gutter side, which comprise suspension arm 13, suspension section 14 and fixing piece 19, additional have a bearing component 20 which, in the mounted condition, abuts on the outer side of supporting leg 6. The spacing between the outer side of bearing component 20 and the inner side 21 of suspension section 14 of gutter 3 corresponds with the clear width of mounting gap 22 of supporting section 2, said gap being formed by supporting leg 6 and holding element 10.

Like the gutter, fixing piece 19 is made of plastic and therefore has certain elastic material properties, so that gutter 3 can be joined by clipping with supporting leg 6 by swinging it inwardly around suspension arm 13 resting on support 11. For this purpose, fixing piece 19 has a run-up surface 23 pointing at supporting leg 6.

Figure 2:
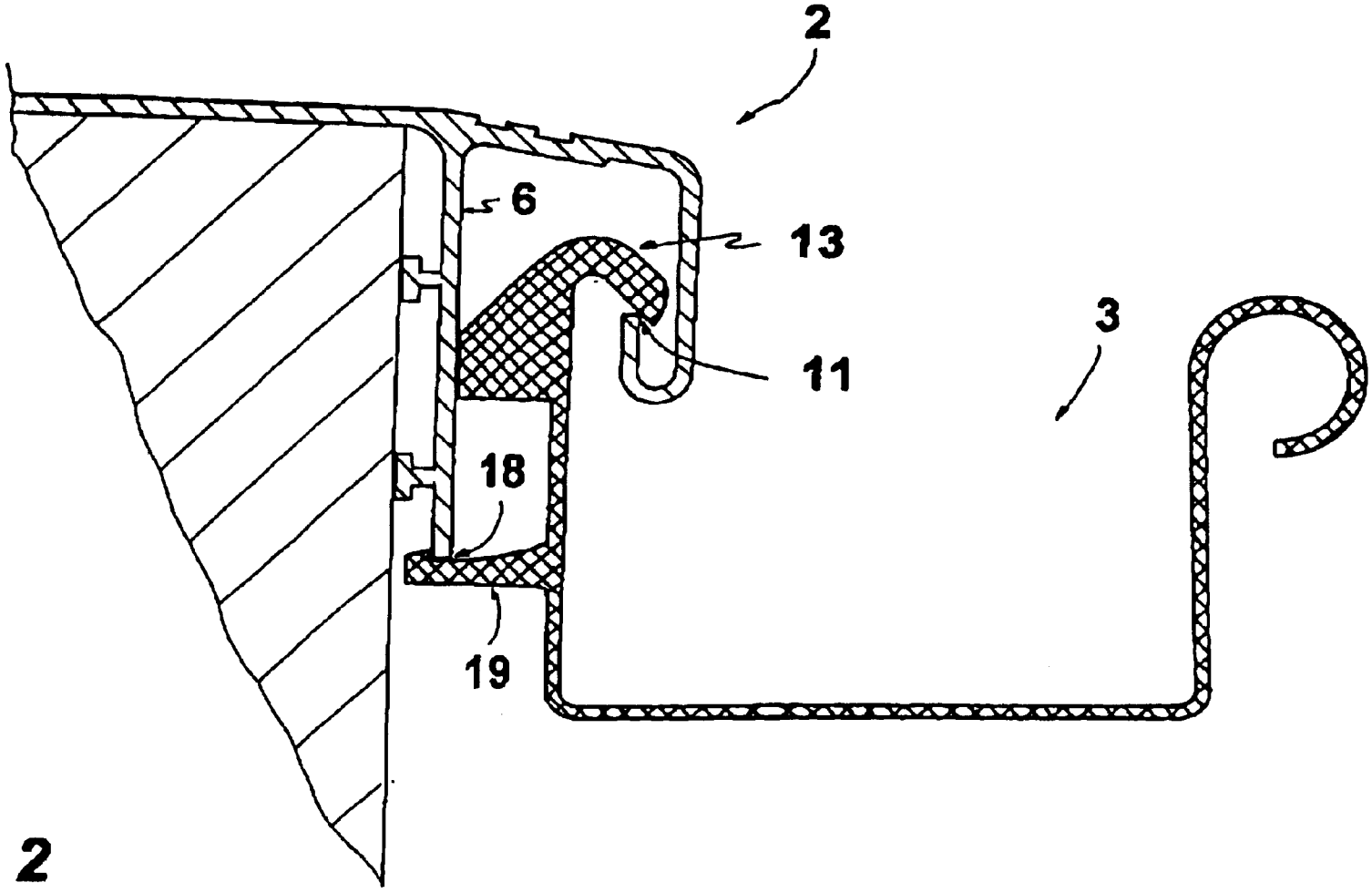
FIG. 2 shows a cross section through the mounted gutter mounting system of FIG. 1.

FIG. 2 shows gutter 3 inserted in supporting section 2. It is clearly shown by this figure that the suspension arm 13 abuts oh support 11 of supporting section 2, and that fixing piece 19 is arranged engaging locking edge 18 of supporting leg 6 from behind. Detaching gutter 3 from supporting section 2 is possible only if fixing piece 19 is bent down from its clamping position, releasing the supporting leg 6. Securing means 13, 14 and 19 on the gutter side are thus clamped between support 11 and locking edge 18 of supporting section 2, so that safe mounting of gutter 3 on the supporting section 2 is assured at any time.

Figure 3:
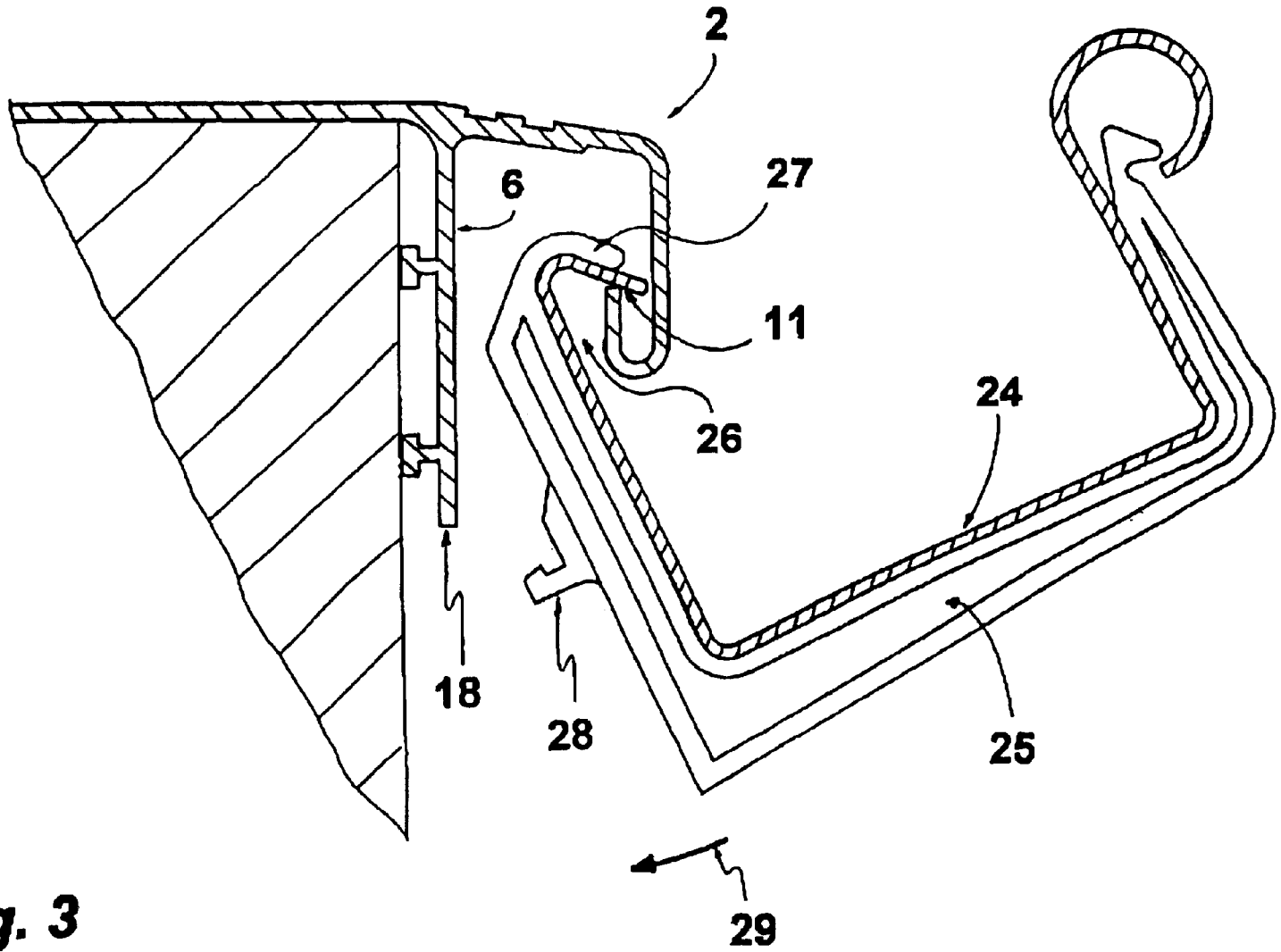
FIG. 3 shows another exemplified embodiment of a gutter mounting system in a first installation position, in which the securing means on the gutter side are arranged on a gutter hook.

FIG. 3 shows an exemplified embodiment in which the securing means on the gutter side are arranged not on a gutter 24 itself but on an additional securing element, namely a gutter hook 25. Conforming to the exemplified embodiment described in connection with FIGS. 1 and 2, gutter hook 25 has in the present case a suspension segment 26 with a suspension arm 27 and a fixing element 28.

FIG. 3 shows a first installation situation, in which gutter 24 with gutter hook 25 rests on support 11 of supporting section 2. By swinging gutter 24 with gutter hook 25 in the direction of arrow 29, gutter hook 25 is clipped to locking edge 18 of supporting leg 6.

Figure 4:
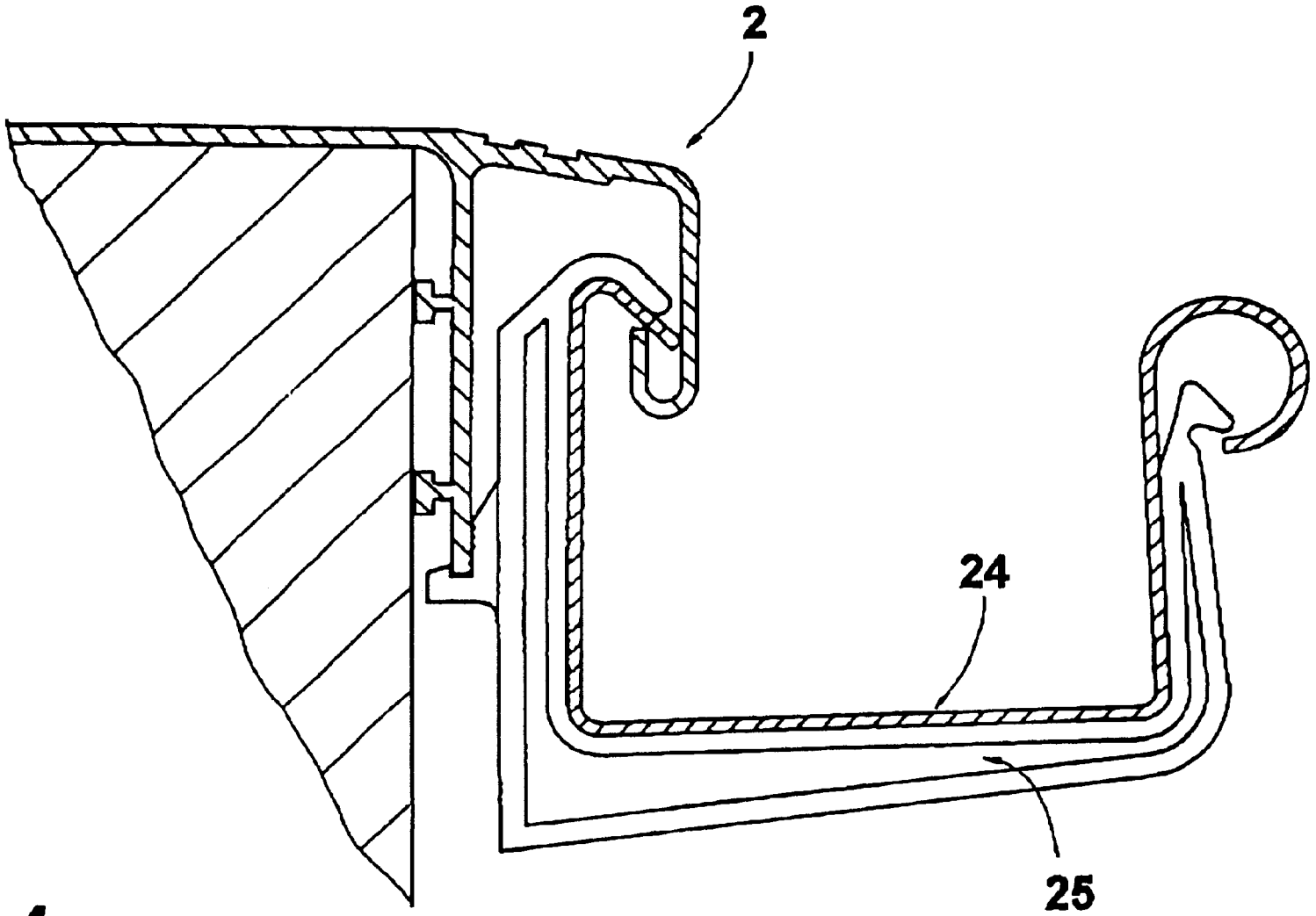
FIG. 4 shows the gutter secured by means of the gutter hook on the securing section of FIG. 3.

FIG. 4 shows the completely mounted gutter 24 with the gutter hook 25 secured on the supporting section 2.

Figure 5:
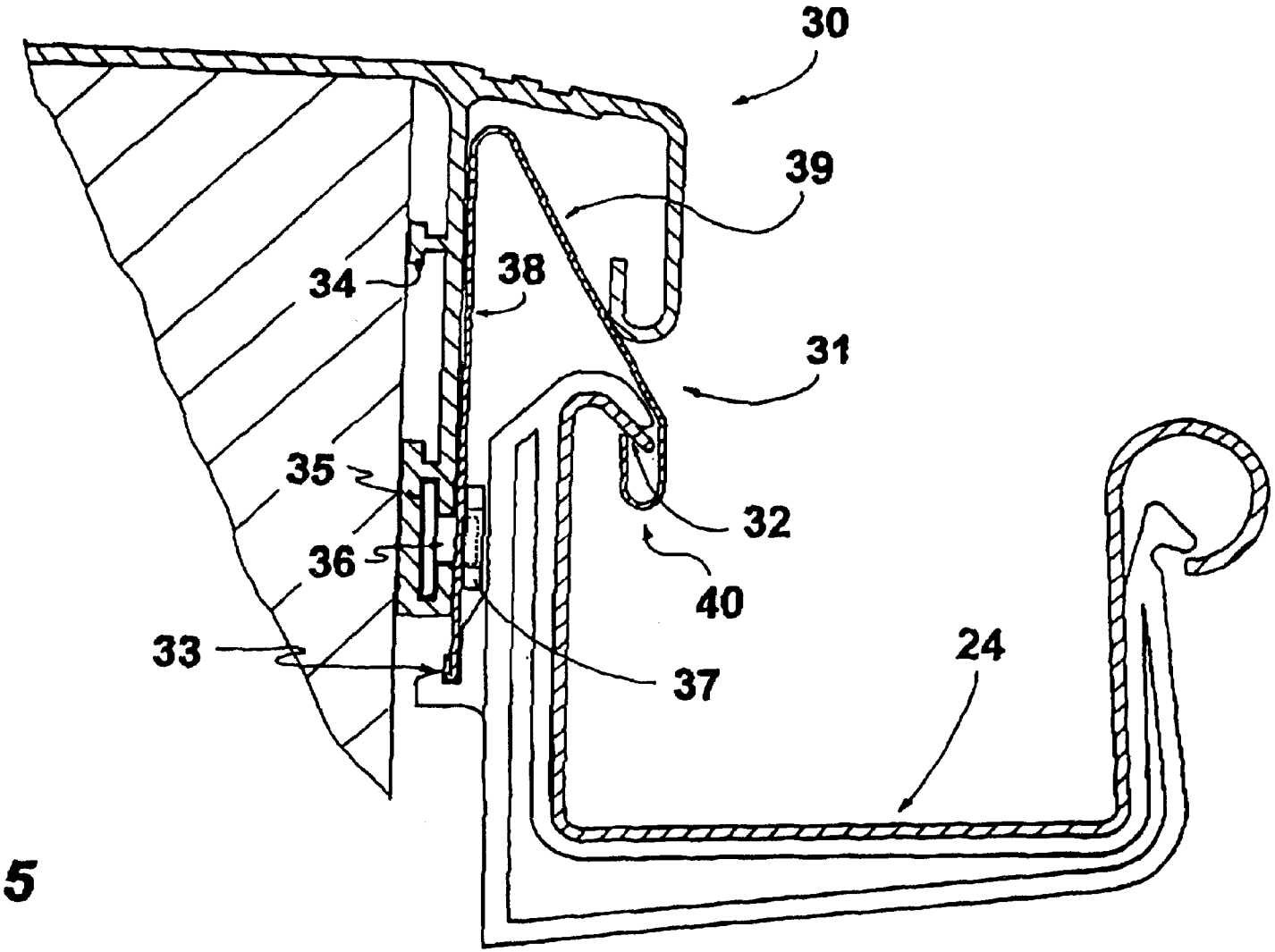
FIG. 5 shows another exemplified embodiment of a gutter mounting system, whose securing means on the side of the securing section are associated with a vertically adjustable connecting section.

In the exemplified embodiment shown in FIG. 5, the securing means on the side of the supporting section are provided on a connection section 31 associated with the supporting section 30. As the supporting section 2 described in connection with FIGS. 1 to 4, connecting section 31 has a support 32 and a locking edge 33. Connecting section 31 is associated with supporting section 30. Supporting section 30 has a supporting bridge 34 and a receiving groove 35. Several groove screws 36 disposed one after the other are inserted in receiving groove 35, said screws each being secured by a nut 37 and holding the connecting section 31. In the exemplified embodiment shown in FIG. 5, a support leg 39 is disposed opposite securing leg 38 of connecting section 31. Leg 39 supports the support 32 because support 32 is supported on holding element 40 of supporting section 30.

Figure 6:
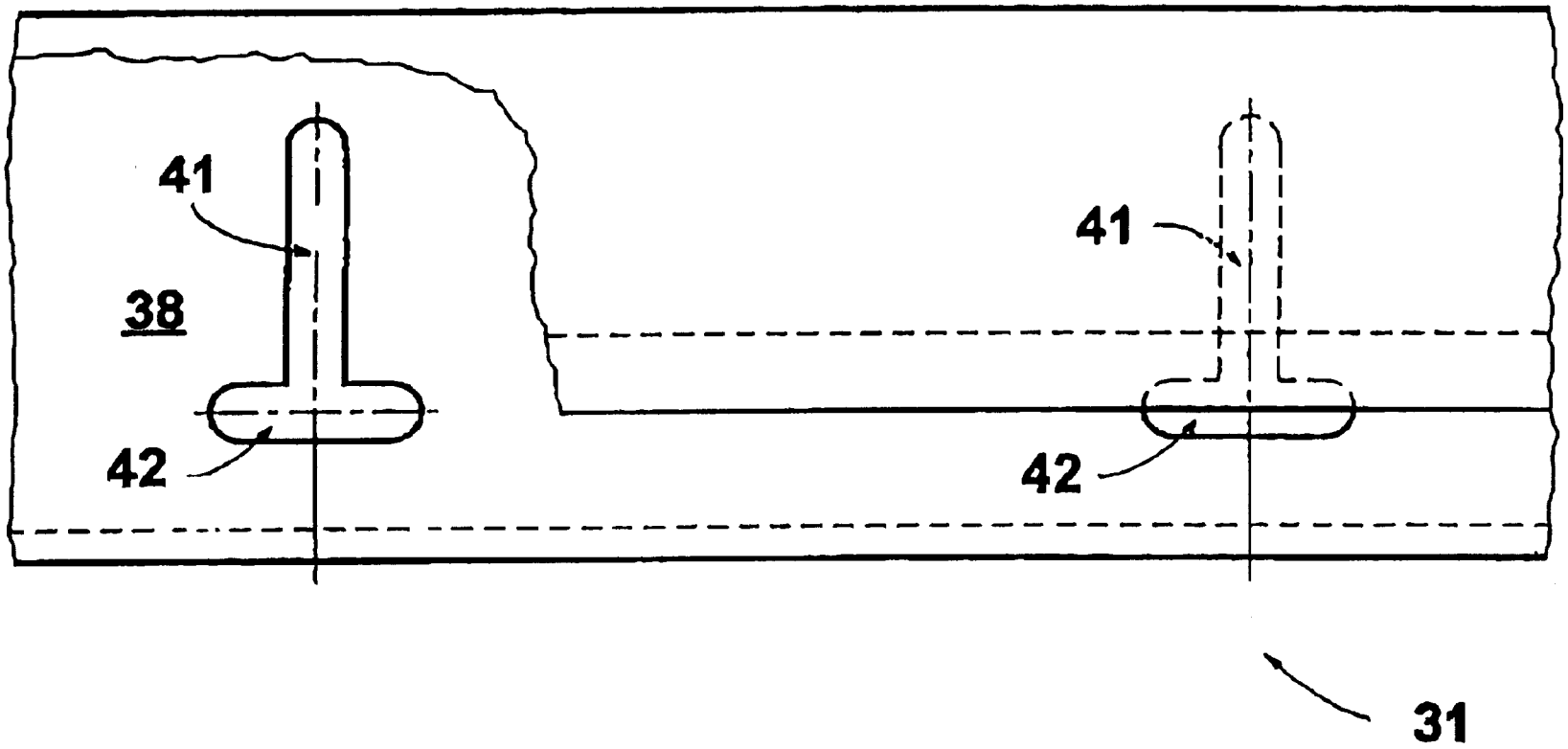
FIG. 6 is a front view of the connecting section of FIG. 5.

As shown in FIG. 6, vertically aligned oblong holes 41 are arranged with.regular spacings in securing leg 38 of connecting section 31, with the screw shafts of groove screws 36 extending through said holes. By making provision for the vertically aligned oblong holes 41, connecting section 31 is vertically adjustable with respect to supporting section 30. The use of a connecting section 31 is particularly useful when a gutter mounted on such a section—either gutter 3 or the gutter 24 held by means of a gutter hook 25—is to be installed with a gradient with respect to supporting section 30.

Furthermore, securing leg 38 of connecting section 31 has horizontally aligned insertion openings 42. Insertion openings 42 serve for inserting the heads of groove screws 36 through the connecting section 31 and into receiving groove 35 of supporting section 30. The heads of groove screws 36 are shaped rectangularly, so that they get canted in receiving groove 35 when the nuts 37 are screwed to the screws, permitting tightening of the nuts 37.

Figure 7:
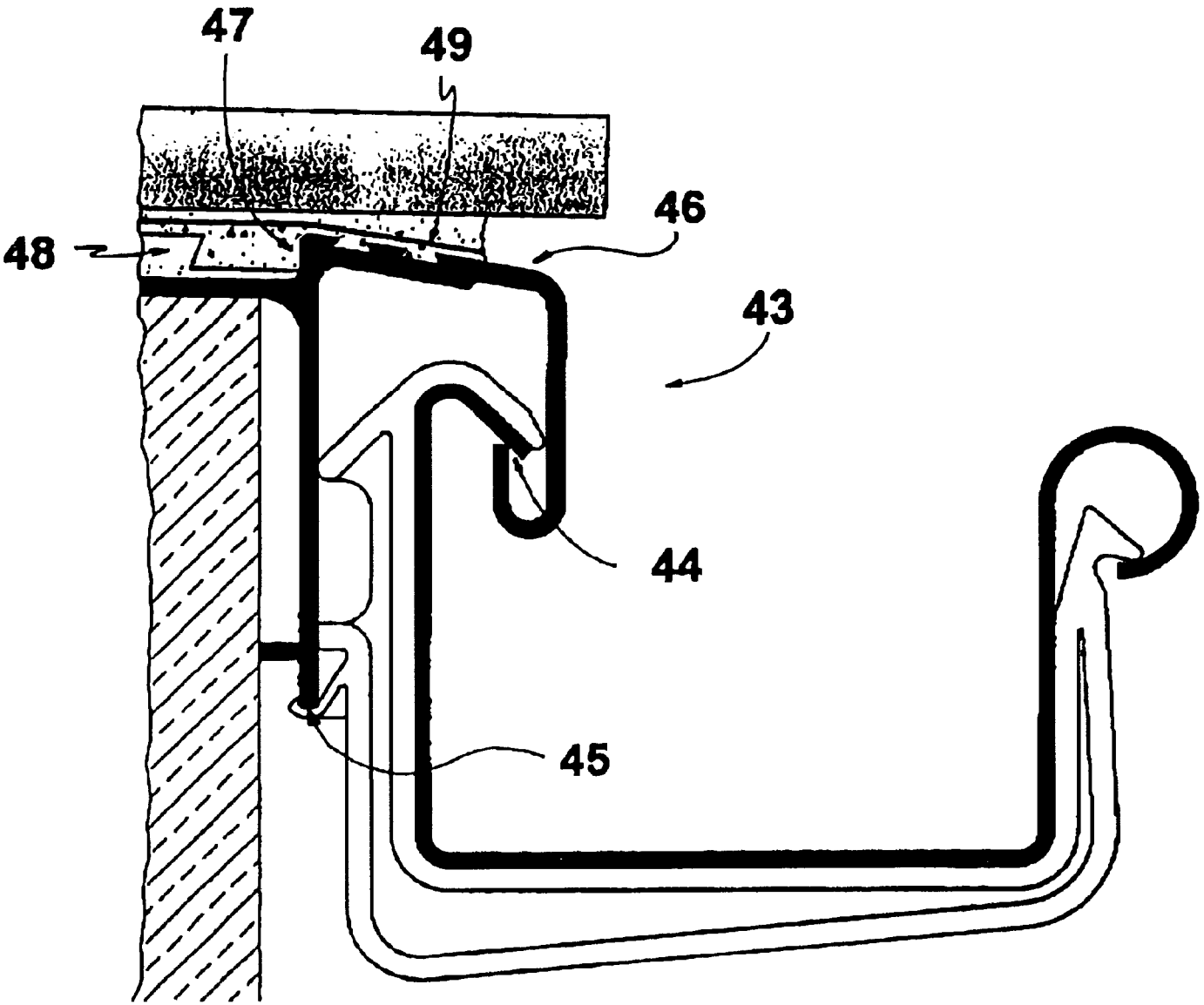
FIG. 7 shows a sectional representation of anther gutter mounting system, whose supporting section has an enclosing edge.

FIG. 7 shows another embodiment of a supporting section 43, which in addition to the securing means—support 44, clamping edge 45—has an enclosing segment 47 adjoining its water drain leg 46. Enclosing segment 47 serves for receiving a sealing mat 48 whose surface is flush with the water drain leg 46. The connection from sealing mat 48 to water drain leg 46 is made with a sealing strip 49.

LIST OF REFERENCE NUMERALS

| | |
|---|---|
| 1 | Gutter mounting system |
| 2 | Supporting section |
| 3 | Gutter |
| 4 | Breakthrough |
| 5 | securing leg |
| 6 | Supporting leg |
| 7 | Visible leg |
| 8 | Water drain leg |
| 9 | Clamping groove |
| 10 | Holding element |
| 11 | Support |
| 12 | Receptacle |
| 13 | Suspension arm |
| 14 | Suspension segment |
| 15 | Supporting bridge |
| 16 | Front side |
| 17 | Balcony base |
| 18 | Locking edge |
| 19 | Fixing piece |
| 20 | Support element |
| 21 | Inside of suspension segment |
| 22 | Securing gap |
| 23 | Run-up surface |
| 24 | Gutter |
| 25 | Gutter hook |
| 26 | Suspension arm |
| 27 | Suspension segment |
| 28 | Fixing piece |
| 29 | Arrow direction |
| 30 | Supporting section |
| 31 | Connecting section |
| 32 | Support |
| 33 | Locking edge |
| 34 | Supporting bridge |
| 35 | Receiving groove |
| 36 | Groove screw |
| 37 | Nut |
| 38 | Securing leg |
| 39 | Supporting leg |
| 40 | Holding element |
| 41 | Oblong hole |
| 42 | Insertion opening |
| 43 | Supporting section |
| 44 | Support |
| 45 | Locking edge |
| 46 | Water drain leg |
| 47 | Enclosing segment |
| 48 | Sealing mat |
| 49 | Sealing strip |

What is claimed is:

1. A device for securing gutters on an end of a balcony or terrace, comprising:

a supporting profile having means adapted for securing the supporting profile on the end of the balcony, with a visible leg adapted to be spaced from and aligned parallel with the end of the balcony, with securing means for mounting a gutter, and with a supporting leg said supporting leg being connected with the visible leg by a water drain leg;

whereby the securing means of the supporting profile comprises a support on a side of the visible leg, and a locking edge on a side of the supporting leg;

a gutter with means for securing said gutter to the supporting profile with a side of the gutter adapted to be adjacent to the end of the balcony, said securing means of the gutter comprising a suspension segment cooperating with the support of the visible leg, and a fixing piece cooperating with the locking edge of the supporting leg, said fixing piece having an elastic extension engaging the locking edge in a mounted condition from behind the locking edge;

whereby the suspension segment of the gutter is insertable into a mounting gap of the supporting profile formed by the support of the visible leg and the locking edge of the supporting leg, so that said extension of the gutter can be clipped into or to the supporting profile, whereby the suspension segment of the gutter abuts on the support of the visible leg of the supporting profile.

2. The device for securing gutters according to claim 1, wherein said support comprises a top edge of a hook-shaped, upwardly open holding element pointing at a mounting base.

3. The device for securing gutters according to claim 1, wherein said suspension segment is hook-shaped and downwardly open and pointing from the gutter to the visible leg.

4. The device according to claim 1, wherein the supporting leg of the supporting profile has means for spacing from the mounting base.

5. The device according to claim 1, wherein said securing means comprises a locking edge and a support on a side of the supporting profile arranged on a connecting section attached to the supporting section.

6. The device according to claim 1, wherein said securing means on the gutter side are molded onto the gutter.

7. The device according to claim 1, wherein said securing means on the gutter side are located on a gutter hook having a gutter receptacle.

8. The device according to claim 1, wherein a supporting section is securable on a side of a wall with a securing leg installable in a floor structure.

9. The device according to claim 2, wherein the holding element is molded onto a supporting section and forms a lower end of the visible leg.

10. The device according to claim 2, wherein the holding element is hook-shaped.

11. The device according to claim 8, comprising a water drain leg of the supporting section having at least one upwardly open dovetail-shaped clamping groove.

12. The device according to claim 8, wherein the securing leg of the supporting section has an edge-forming enclosing section for receiving a drainage mat, said enclosing section being located in an outer zone of the securing leg close to an end of the wall.

13. The device according to claim 4, wherein the locking edge provided as the securing means on the side of the supporting leg forms a lower end of the supporting leg.

14. The device according to claim 4, comprising means for maintaining a spacing of the supporting leg from the mounting base which comprises supporting bridges molded onto the supporting leg.

15. The device according to claim 14, comprising a supporting bridge being a receiving groove and said receiving groove being open on a front side.

16. The device according to claim 15, wherein the locking edge comprises the lower edge of the receiving groove, and said receiving groove being open on the front side.

17. The device according to claim 15, comprising said securing means inserted into said receiving groove of the supporting leg, and a connecting section of a supporting section is vertically adjustable and securable.

18. The device according to claim 17, comprising groove screws as securing means for vertical adjustability of the connecting section, said screws engaging vertically aligned oblong holes in the connecting section and being secured with nuts.

* * * * *